US005725148A

United States Patent [19]

Hartman

[11] Patent Number: 5,725,148

[45] Date of Patent: Mar. 10, 1998

[54] INDIVIDUAL WORKSPACE ENVIRONMENTAL CONTROL

[76] Inventor: Thomas B. Hartman, 9905 39th Dr. NE., Marysville, Wash. 98270-9116

[21] Appl. No.: 586,337

[22] Filed: Jan. 16, 1996

[51] Int. Cl.[6] ..... F24F 7/00; F24F 7/02

[52] U.S. Cl. ..... 236/49.3; 165/217; 219/201; 236/47; 454/250

[58] Field of Search ..... 236/49.3, 51, 47; 454/258, 286, 333; 165/217, 212; 219/201

[56] References Cited

U.S. PATENT DOCUMENTS

| | | | |
|---|---|---|---|
| 4,318,508 | 3/1982 | Glasgow et al. | 236/47 |
| 4,406,397 | 9/1983 | Kamata et al. | 165/212 X |
| 4,515,069 | 5/1985 | Kline | 454/258 X |
| 4,545,524 | 10/1985 | Zelczer | 236/46 R |
| 4,630,221 | 12/1986 | Heckenbach et al. | 364/505 |
| 4,646,964 | 3/1987 | Parker et al. | 236/49.3 |
| 4,718,021 | 1/1988 | Timblin | 364/505 |
| 4,723,593 | 2/1988 | Kuribayashi | 165/11.1 |
| 5,117,900 | 6/1992 | Cox | 165/53 |
| 5,179,524 | 1/1993 | Parket et al. | 236/49.4 X |
| 5,251,814 | 10/1993 | Warashina et al. | 62/186 X |
| 5,251,815 | 10/1993 | Foye | 236/51 X |
| 5,271,558 | 12/1993 | Hampton | 454/258 |
| 5,275,333 | 1/1994 | Tamblyn | 236/51 |
| 5,318,224 | 6/1994 | Darby et al. | 236/47 |
| 5,341,988 | 8/1994 | Rein et al. | 236/49.3 |
| 5,344,069 | 9/1994 | Narikiyo | 236/1.8 X |
| 5,360,374 | 11/1994 | Wyon et al. | 454/306 |
| 5,361,985 | 11/1994 | Rein et al. | 236/49.3 |
| 5,547,018 | 8/1996 | Takahashi et al. | 454/258 X |

FOREIGN PATENT DOCUMENTS

| | | | |
|---|---|---|---|
| 1169256 | 7/1989 | Japan | 454/258 |
| 4009540 | 1/1992 | Japan | 454/258 |

*Primary Examiner*—William E. Wayner

*Attorney, Agent, or Firm*—Marger Johnson McCollom & Stolowitz, P.C.

[57] ABSTRACT

In building environmental control, primary HVAC services are supplemented to improve individual user comfort by automatically adjusting lighting levels and airflow direction mix in the individual workspace. An individual terminal unit provides these individualized supplemental services without affecting loading on the primary HVAC system. Multiple individual terminal units disposed in an open, common area communicate with one another and adjust operations in response to neighborhood conditions to improve overall system efficiency and save energy while optimizing individual user comfort.

37 Claims, 9 Drawing Sheets

INDIVIDUAL WORKSPACE ENVIRONMENTAL CONTROL

The present invention is in the general field of environmental control in commercial and institutional building workspaces. More specifically, the present invention is directed to control of airflow, lighting and temperature in each individual worker's space, tailored to the needs of that individual, whether that workspace be a private office or an area within a larger area among other users. Moreover, the present invention provides for improved efficiency and energy savings while improving comfort at the individual user level.

BACKGROUND OF THE INVENTION

There is a growing understanding of the need to provide individual workspace environmental control in modem office buildings. For example, some studies have suggested a link between an office worker's sense of comfort and well-being and his/her productivity. Research has also shown that them is variation within any population of people and tasks being formed as to what constitutes thermal and visual comfort. By "thermal comfort" we mean an individual's perception that their immediate surrounding is not too hot or too cold. Similarly, "visual comfort" can be used to describe an ambient lighting level that the user perceives as adequate for the task at hand. Historically, temperature is controlled by a wall thermostat for a floor or zone of a building. Lighting conventionally is controlled by rheostats or light switches that control specific lights or banks of lights. In both cases, the prior art control mechanisms do not adequately serve the individual worker's comfort needs, especially in open office areas.

Variable air volume (VAV) systems have been employed for heating and air conditioning in commercial buildings for some years. They are currently the system of choice by the industry, and widely used in office and institutional buildings. In a variable air volume system, one or more central air supply systems are sized to meet the peak cooling (and/or heating) conditions for the building. Several "terminal units" or "boxes" are located in respective zones or offices throughout the building, each connected via ducts to the central air supply. Each terminal unit is sized to meet peak conditions of the space it serves which may or may not coincide with the building's peak conditions. Each terminal unit in a variable volume air system is provided with a preset box maximum airflow. The unit reacts to meet the loads on the corresponding space (or "zone") as determined by a space temperature sensor, and provides airflow to cool (or heat) the space up to that preset maximum airflow. No further airflow will be delivered no matter how much further the space temperature varies from predetermined setpoint conditions. Thus, the prior art terminal unit maximum airflow constrains the unit to ensure that a reasonable balance of airflow is available to all units and all times, even when some zones may be experiencing severe or unusual loads. Moreover, considerable time and expense is required to "balance" variable airflow systems at the time of their installation to achieve the desired distribution of air, and manufacturers typically recommend rebalancing every few years as the loads in each zone change.

An example of a variable air volume ventilating system is shown in U.S. Pat. No. 5,005,636. Variable air volume terminal units are shown in U.S. Pat. No. 4,942,921 to Haessig et al. In general, the prior art terminal units respond to zone temperature (and temperature setpoints), without taking into account other conditions within the zone or in other zones. Moreover, prior art terminal units respond to temperature changes solely by varying airflow volume and/or mix of conditioned and return air. They make no attempt to take into account or to influence other conditions, such as lighting level or airflow direction, that affect user comfort together with zone temperature.

SUMMARY OF THE INVENTION

One aspect of the present invention is an individual terminal unit to provide individual environmental control including the ability to adjust lighting level, airflow direction and discharge air temperature. The new individual terminal unit is installed in the building in or over the ceiling of an individual workspace. Each terminal unit can be configured during a setup procedure to operate (1) independently, as in a closed individual office; (2) as part of a group of units serving a larger area; or (3) as one of multiple units serving a common open area.

Another aspect of the invention is a method for improving the comfort of a user in an individual workspace within a building. Improving user comfort is accomplished by providing one or more "supplemental services" under certain conditions. These services are in addition to—and thus supplement—conventional heating and cooling services. Supplemental services improve comfort for the individual user without substantially affecting the environment outside the individual workspace or load on the primary supply. At the same time, these services are coordinated with the primary heating and cooling services. Moreover, individual terminal units, according to the invention, take into account conditions in neighboring workspaces so that they are not working against each other.

In one embodiment of the invention, a "cooling threshold" temperature is established for an individual's workspace, and the individual workspace actual temperature is monitored. The cooling threshold temperature is distinguished from, and higher than, the conventional cooling setpoint. In addition, the workspace is monitored to detect occupancy. When the workspace is occupied and the workspace temperature is below the threshold temperature, the primary air supply volume into the individual workspace is modulated in response to the actual temperature in the usual fashion. If the workspace temperature nonetheless climbs beyond the threshold temperature, supplemental comfort services are initiated in the individual workspace.

One of the supplemental services includes automatically lowering the individual workspace lighting level so as to improve the user's comfort while the workspace temperature exceeds the threshold temperature. While lowering the lighting level may have only a minor effect on radiated heat, it also makes the user "feel" somewhat more comfortable in a warm environment.

Another mode of supplemental services includes automatically controlling the airflow into the workspace. Here I do not mean controlling the volume of airflow (which is conventional); but controlling how that airflow is delivered into the space. An improved damper apparatus divides the airflow so as to deliver one portion of it into the space in a generally horizontal direction, i.e. along the ceiling, while another portion of the airflow is delivered substantially downward. Adjusting the airflow direction mix—what portion horizontal versus what portion vertical—is one method of improving the user's comfort while the workspace is too warm or too cold. Another aspect of the invention is to improve efficiency by directing airflow directly downward into the workspace when it is not occupied to improve the efficiency of heating or cooling delivery to the workspace. A third supplemental service comprises automatically employing a radiant heat source when appropriate.

Another important aspect of the invention is the coordination of operations among multiple individual terminal units. Two arrangements are described. In one case, multiple units are configured to operate together as a group to serve a large enclosed office. In the other case, many units may be spread over a large open area, each unit serving a respective individual person's workspace. Here, the individual terminal unit takes into account conditions in nearby "neighborhood" units to most efficiently provide comfort services as required by the corresponding user. This coordination reduces the inefficiencies of prior art systems in which adjacent units sometimes work against each other, e.g. one unit trying to heat a work area while a nearby unit is trying to cool a neighboring area.

Applying occupancy sensing capacity of individual workspace terminal units is advantageous for control of heating, cooling and ventilation. The terminal unit controller provides light dimming and reduces ventilation air anytime the occupant is absent, even for short periods. For longer periods of unoccupancy, the unit can be programmed to shut lights off and to widen the heating/cooling setpoints, thereby saving energy.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Introduction

Figure 1:
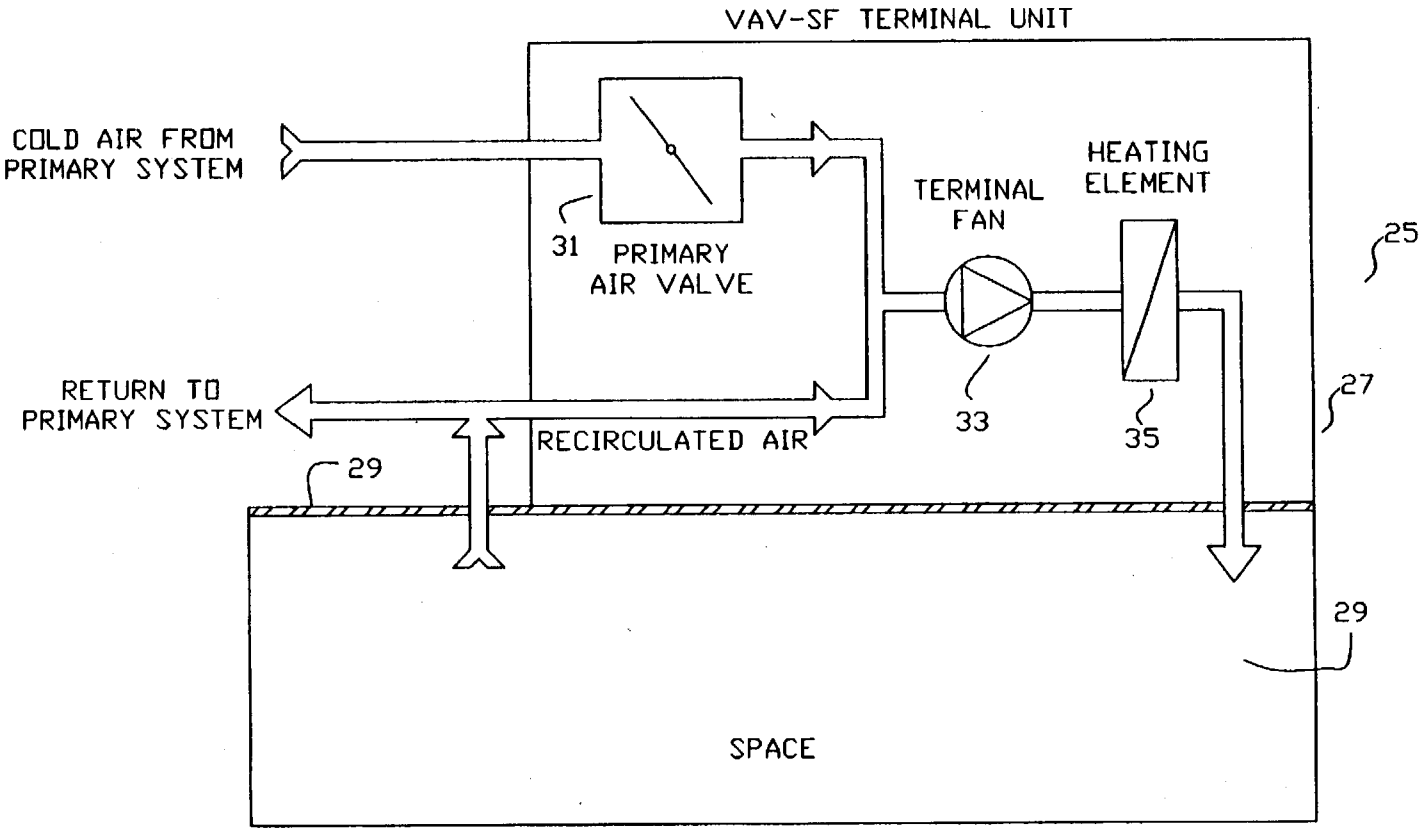
FIGURE 1 (PRIOR ART)
FIG. 1 is a functional block diagram illustrating a prior art terminal unit.

FIG. 1 illustrates one example of a prior art terminal unit. The terminal unit 27 is mounted in a plenum above a ceiling 28 over a user space 29. Cold air from a primary supply system (not shown) is provided to the terminal unit through a primary air valve 31, which in turn provides the cold air to a terminal fan 33. The terminal fan drives the air through a heating element 35 and into the user space below. Typically a diffuser (71 in FIG. 2) deflects the air horizontally along the ceiling 28 so as to avoid drafts in the user space. Return air flows from the user space through a return to the primary system. This arrangement is referred to as a variable air volume—series fan terminal unit. Return air removed from the user space also is provided at the inlet to fan 33 for recirculation mixed together with air from the primary system in a mixture controlled by the primary air valve 31. Air valve 31 is modulated in response to space temperature so as to provide more or less cold air as needed. Dual-duct systems which provide both warm and cold air from a primary supply are known in the prior art as well.

Figure 2:
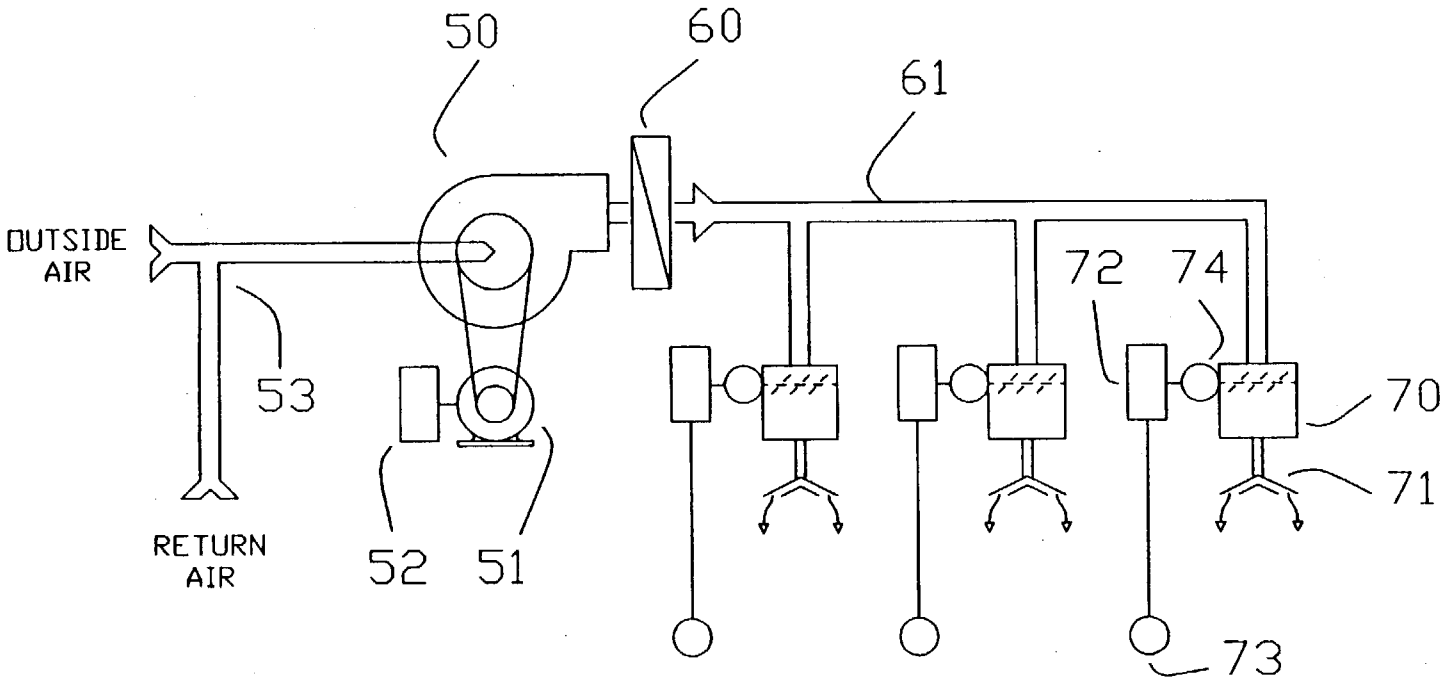
FIG. 2 is a functional block diagram illustrating a prior art variable air volume air conditioning system.

FIG. 2 illustrates a prior art VAV system. An air supply device 50 which draws a return and/or outside air or combination thereof through duct 53. The air may be further conditioned by one or more heating or cooling coils 60 and delivered to one or more zones via supply duct 61. The flow of air is regulated to meet the demand at the terminal boxes 70 by a controller 52 which adjusts the motor 51 or air vanes.

Each terminal box receives air through supply duct 61 and distributes it to the appropriate zone through secondary supply duct(s) and diffuser(s) 71. A space temperature sensor 73 located within the conditioned space signals the box controller 72 of the current space temperature conditions. Based in part on the space temperature conditions, the controller 72 regulates the flow of air into the space by operating a flow regulation damper and operator 74.

Some versions involve a single duct which provides conditioned air for cooling and ventilation. Heating is provided by a separate but often interconnected system or series of devices. Other variations utilized two supply ducts, one of which provides cool air and the other warm air. Operation of the two duct version is very similar to the single duct version shown.

New Individual Terminal Unit Mechanical Description

Figure 3:
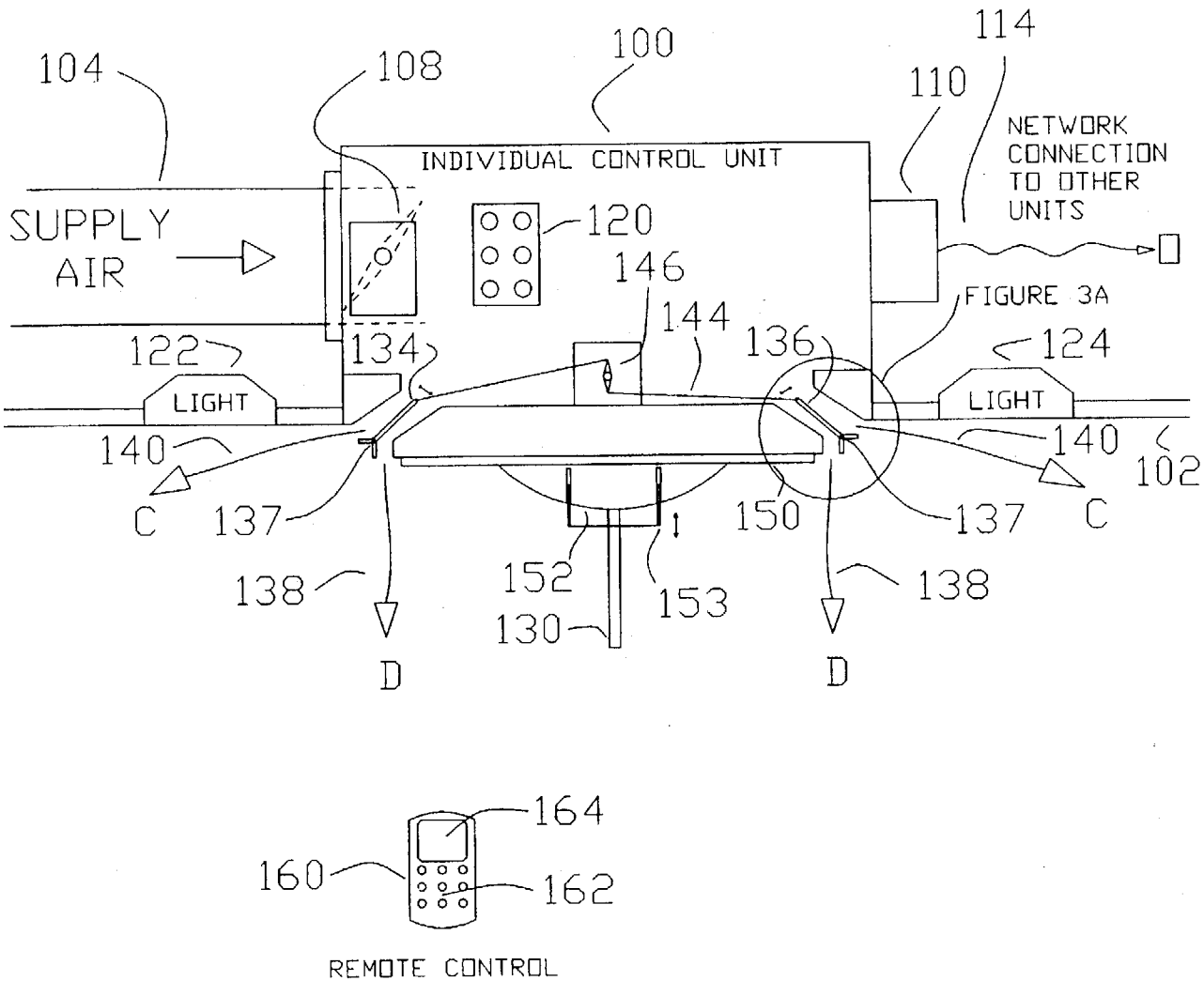
FIG. 3 is a cross-sectional view illustrating an individual terminal unit according to the present invention installed in a ceiling above a workspace.

FIG. 3 is a cross-sectional view of a new individual terminal unit 100 according to the present invention, installed in the ceiling 102 over a workspace. The terminal unit 100 includes an inlet duct for connection to a supply duct 104 to receive a supply of conditioned air from a primary supply system which may be conventional. An airflow sensor, e.g. a single point "hotwire" airflow sensor, modulating damper and actuator 108 are arranged to regulate the amount of flow into the control unit 100 from the duct 104. The modulating damper and actuator respond to demand as controlled by a computer or microcontroller 110. Microcontroller 110 also is coupled via communications link 114 to other individual control units as further described below.

Communication link 114 can provide for communication of setpoints, local zone temperature, occupancy, etc. This information can be used to coordinate operation among neighboring units, as will be described later. Control unit 100 may also include a reheating element 120 for conditioning the primary airflow (or optionally by mixing it with air of different temperatures from different ducts which are not shown in this drawing). The reheating unit 120 also responds to zone temperature and demand as determined by the microcontroller 110. Light fixtures 122, 124 also are coupled to the microcontroller 110. The lighting equipment is designed to provide adjustable lighting levels, settable by the microcontroller. The microcontroller sets the nominal lighting level as indicated by the user—the lighting level setpoint—and adjusts it automatically in response to changing conditions as will be explained.

Figure 3A:
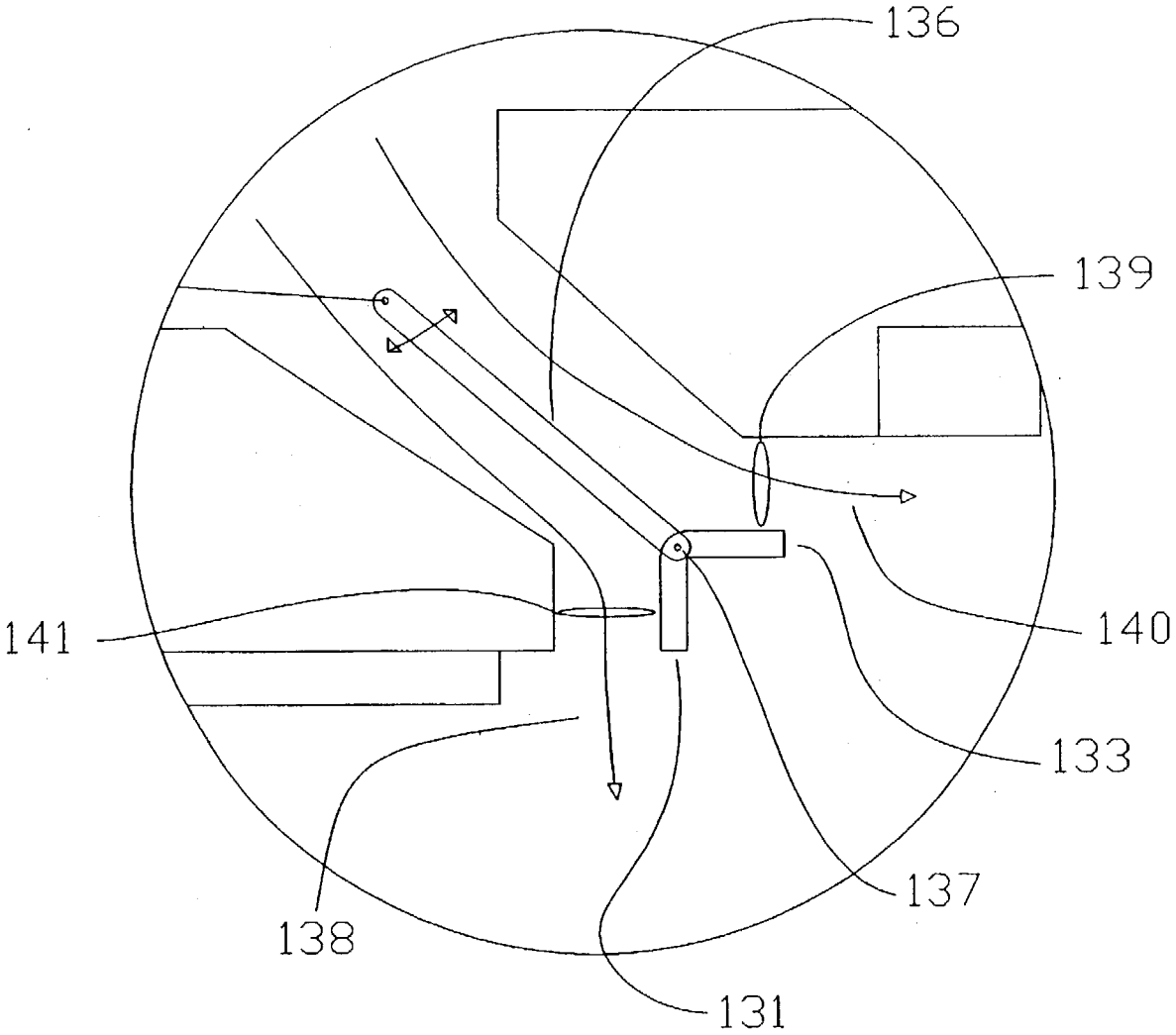
FIG. 3A is an enlarged view of a portion of the terminal unit of FIG. 3 showing detail of a regulating vane and outlet ports.

A space temperature sensor 130 is coupled to microcontroller 110 to provide space temperature information. A 10 K-ohm thermistor, for example, can be used, such as that available commercially from Alpha Thermistor & Assembly, Inc. of San Diego, Calif. part no. 13A1002-1. A diffuser portion of the unit includes adjustable regulating vanes 134, 136 for controlling a direction mix of the air distributed into the workspace. The regulating vanes 134, 136 are coupled through linkage 144 to an actuator 146 which in turn is controlled by the microcontroller 110. Each regulating vane, for example vane 136, is arranged to pivot about a fixed pivot point 137. A first baffle 131 extends generally downward from the pivot point, and together with the regulating vane forms a downward outlet port 141. Thus, outlet port 141 directs a portion of the air from the inlet duct 104 into the workspace along a generally downward (or "direct") path 138. A second baffle 133 extends generally horizontally from the same pivot point 137, and together with the regulating vane forms a horizontal outlet port 139. Outlet port 139 directs a portion of the air from the inlet duct 104 into the workspace along a generally horizontally (or "indirect") path 140. In this way, pivoting the regulating vanes (under control of the processor 110) adjusts what portion of the supply air is delivered into the space along the ceiling, and conversely what portion of the supply air is directed downward into the space. The regulating vane position thus determines an airflow direction mix, which can be described as a percentage of indirect (i.e. horizontal) airflow. Downward (direct) airflow is most efficient for air delivery, but it can cause annoying drafts. The present invention includes strategies for adjusting airflow direction mix under various conditions so as to maximize user comfort while improving HVAC efficiency, as further explained later. FIG. 3A is an enlarged view of the circled portion of the unit, showing the regulating vane and outlet ports in greater detail.

A radiant heating unit 150 can be included to provide radiant heating into the workspace. One example of a suitable radiant heating panel is available from SSHC, Inc. of Old Saybrook, Conn. identified as Enerjoy Radiant Heatmodule Model 22RP-4. An occupancy sensor 152 provides an indication to the microcontroller 110 as to whether or not the space is occupied. One example of a suitable passive, infrared occupancy sensor is that available from Sensor Switch, Inc. of Wallingford, Conn.—part no. CM-MOT. An adjustable shroud 153 provides for limiting lateral range of the occupancy sensor when the unit is used in relatively close proximity to another unit, for example in a neighborhood configuration described below. Preferably, the individual terminal unit is designed to fit into a standard 2 by 2 foot ceiling grid.

Temperature, airflow direction mix and lighting level are all settable by the user according to individual needs. The values of these variables, as set by the user, are called setpoints. Manual adjustments of the setpoints are made by the occupant through a control panel (not shown) or preferably through a remote control unit 160 that includes a keypad 162 and display screen 164 for interactively interfacing with the microcontroller. The microcontroller assumes predetermined default setpoints unless and until the user makes a manual adjustment, so that the unit can be installed and used right "out of the box". The remote control display screen can be implemented as a small panel, e.g. using electroluminescent, LED or other known display technologies. A few square inches of display area will suffice, although the particulars of the display and its dimensions are not critical to the invention. Further details of the remote control, display panel, microcontroller, etc. will be apparent to those skilled in the art in view of the present disclosure.

In general, whenever the workspace is occupied as detected by the occupancy sensor 152, control unit 100 provides thermal, air distribution and lighting levels in response to the current setpoints. For example, during occupancy, if the workspace temperature as detected by temperature sensor 130 is substantially above the current temperature setpoint, then a combination of services are automatically adjusted by the microcontroller 110 to provide at least a perception of thermal comfort as quickly as possible. Conversely, if the space is substantially below the temperature setpoint, then the radiant heating panel 150 is activated, the air distribution mix is adjusted toward the horizontal path 140 to avoid drafts, and the lighting level provided by lights 122, 124 is increased by the microcontroller to a brighter level. All of these services are supplementary, and in addition, to the warm air provided to the space via the supply duct 104 and reheating unit 120. As the space thermal condition improves, these services will be curtailed. When the space temperature is within a predetermined range near setpoint, these supplemental services are or disabled or reset to their normal (setpoint) levels. Operation of the individual control unit 100 is described in greater detail below, beginning with a setup procedure.

Setup of the Individual Terminal Unit

At installation time, the user or installer determines how each individual control unit will be used. The microcontroller system is configured accordingly, for example through an interactive setup program using the remote control. (Password protection may be used to prevent unauthorized persons from changing the unit setup. Moreover, password protection might also be used to allow only authorized users to change workspace setpoints). Anytime an area served by the unit is occupied, an appropriate combination of environmental services will be provided, depending on how the unit is set up. Specifically, the setup program (or other selection means such as switches) allows the user to select from the following modes of operation of the unit:

A. Independently installed in an enclosed office (this is the default setting).

B. Installed as a "group member" to assist in serving a large enclosed office.

C. Installed in a open office area in which full height (floor to ceiling) partitions separating the space from others do not exist.

The following description proceeds first assuming the independent mode of operation.

Automatic Control of Supplemental Comfort Services

Introduction to Supplemental Services

Figure 4:
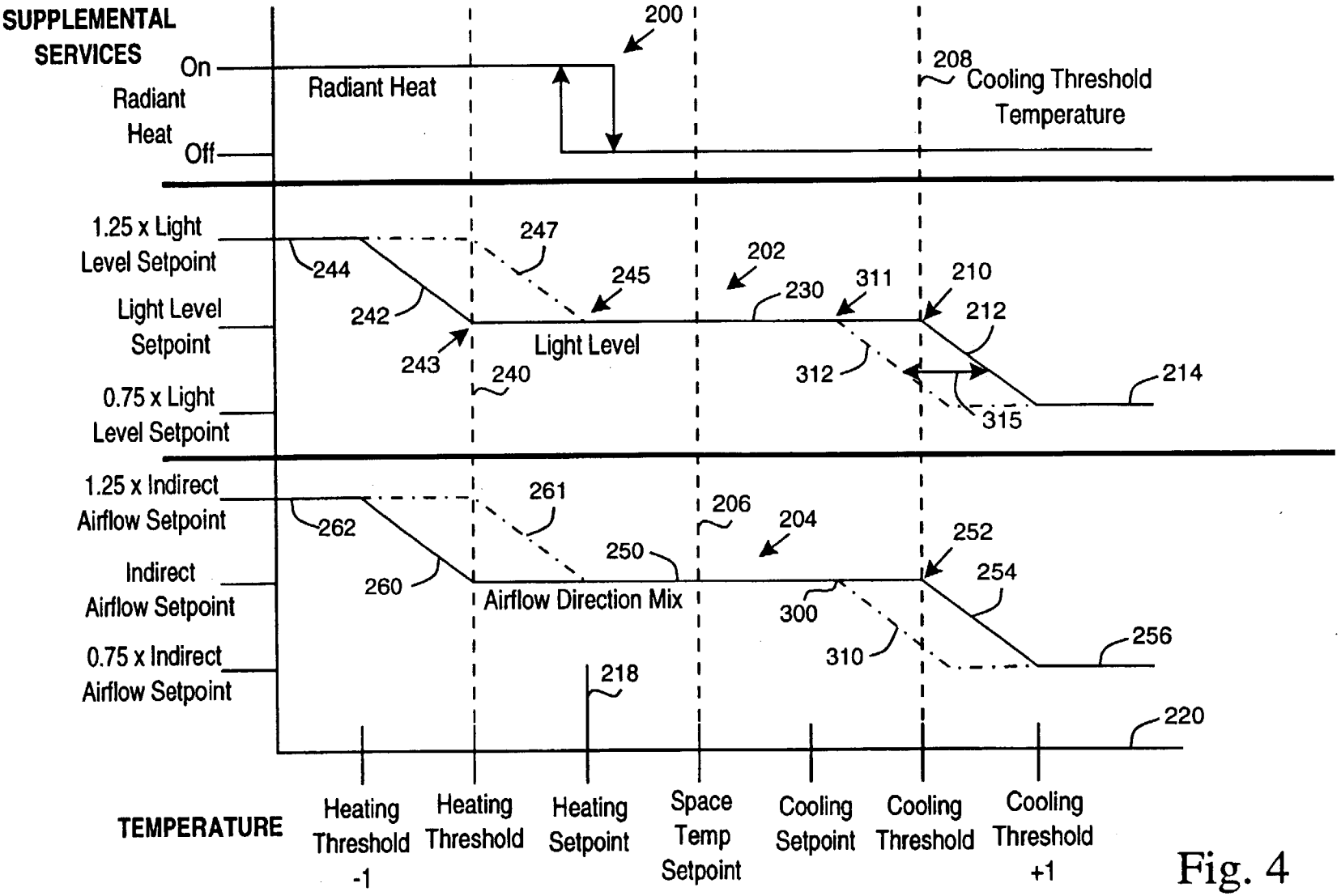
FIG. 4 is a graph illustrating operation of the supplemental services capabilities of the individual terminal unit of FIG. 3 to control radiant heating, airflow direction mix and lighting level in the workspace.

FIG. 4 illustrates operation of the three different supplemental comfort services mentioned above—radiant heating, lighting level and airflow direction mix. Each of the supplemental services is provided in dependence upon local zone temperature and setpoints, as described by the operating curves shown in FIG. 4. Curve 200 illustrates control of a radiant heat source, such a the radiant heat panel 150 of FIG. 3. Curve 202 illustrates adjustment of the workspace lighting level. Curve 204 illustrates adjustment of airflow direction mix. Each of these supplemental services, in turn, will be described in greater detail.

The graph of FIG. 4 indicates temperature—i.e. local zone or workspace temperature—along the horizontal axis 220, at an approximate scale of one degree F. per division.

The temperatures indicated, however, are merely illustrative and not limiting. The zone temperature may be determined by a terminal unit sensor, or by an affiliated group member unit sensor as noted above. Dashed line 206 indicates the space temperature setpoint. It may be determined by user input, e.g. by indicating a desired workspace temperature, for example 68 degrees F. through the remote control as illustrated, or wall mounted control, or through a central system control via the communication link. "Zone" or "workspace" is used in this description to refer to an individual office or an area of a building in which heating, cooling and ventilation requirements are provided by a corresponding individual terminal unit. The same principles are applicable to residential living spaces as well.

The terminal unit controller determines a zone "cooling setpoint" as a predetermined increment, for example 1 degree F. above the workspace temperature setpoint. The unit also assumes as a "heating setpoint" a predetermined temperature increment, again perhaps 1 degree F., below the workspace temperature setpoint. (Alternatively, the heating and cooling setpoints may be set by the user separately). There is a "dead band" between the heating and cooling setpoints, which is typically on the order of 2 degrees F. and generally is symmetrically centered about the workspace temperature setpoint. Heated airflow volume is zero in the deadband, while cooling airflow is at a minimum level selected for ventilation as is known. The terminal unit is not otherwise "activated" until the corresponding zone temperature either exceeds the cooling setpoint (in which case additional cooling is needed), or falls below the heating setpoint (in which case heating is needed). The primary services are not illustrated in this graph. In the following discussion, the cooling mode of operation of supplemental services is described in detail. The heating mode of operation is described only briefly where it is analogous to the cooling mode of operation.

Lighting Level Control

Above the cooling setpoint, we define a cooling threshold temperature 208, generally one degree F. above the cooling setpoint. Referring initially to the nominal workspace temperature setpoint 206, as temperature increases, moving to the right on the light level curve 202, the primary cooling service is provided (not shown) when the zone temperature exceeds the cooling setpoint, as in prior art. Thus, the volume of cooled air flowing into the space is increased. If the temperature further increases, to the knee 210 of the light level curve 202, which is at the cooling threshold, then the microcontroller in the terminal unit begins to reduce the lighting level, from the initial light level setpoint, further reducing the light level as temperature further increases, as indicated along ramp 212 of curve 202. This reduction in lighting level need not necessarily be linearly proportional to temperature deviation from cooling threshold, but such an approach is useful and simplifies calculations in the unit controller. At a predetermined minimum light level indicated by reference 214, e.g. 0.75 times the nominal light level setpoint, the light level is held constant without regard to further increases in zone temperature, thereby ensuring at least a minimum light level while the zone is occupied. When the zone is not occupied, the lights can be turned off entirely to help cooling.

At zones temperatures around the workspace temperature setpoint 202, the light level is maintained at the initial (or default) light level setpoint 230, down to a heating threshold temperature, e.g. heating setpoint minus one degree, indicated by dashed line 240. At this point, knee 243, a further decrease in zone temperature results in increasing the workspace light level, as indicated by ramp 242. This increase, again, need not necessarily be linearly proportional to temperature drop, but such an approach is useful and simplifies calculations in the unit controller. Note the heating threshold temperature 240 should not be confused with the heating setpoint. The heating setpoint, known in prior art, is simply the temperature at which the primary heating service is initiated—flowing warm air into the space. The supplementary services of the present invention, such as lighting level adjustment, are employed when the space temperature is beyond the setpoint temperature (heating or cooling) by more than a selected increment, say one degree F. This increment is automatically adjusted in some circumstances as explained later.

At a predetermined maximum light level indicated by reference 244, e.g. 1.25 times the nominal light level setpoint, the light level is held constant without regard to further decreases in zone temperature, thereby limiting the light level to avoid excessive energy consumption or damage to lighting equipment or bulbs. Some lighting systems cannot conveniently provide for continuous adjustment of lighting levels. For example, some types of fluorescent bulbs cannot be driven at reduced voltage levels without special driver electronics. Nonetheless, the present invention is useful even where only a few discrete lighting levels are available. (In such cases, the ramps 242, 212 would assume a "staircase" characteristic.)

Airflow Direction Mix Control

Airflow direction mix control is employed as a supplementary service to take advantage of relatively direct airflow toward the occupant to improve comfort when the space is too hot; and conversely to use indirect airflow, thereby minimizing drafts, when the space is too cold. At setup time (or anytime), the user sets a preferred airflow direction mix, the indirect airflow setpoint, indicated in FIG. 4 as the horizontal level 250 of the airflow direction mix curve 204. The user is assumed to be located generally below the terminal unit, as the unit is ceiling mounted. Thus, direct airflow, i.e. toward the user, is downward, whereas indirect airflow is directed substantially horizontally along the ceiling. The direction mix setting is expressed as a percentage of indirect airflow, so that 100 percent would be essentially horizontal airflow across the ceiling. At the other extreme, 0 percent indirect (i.e. direct) corresponds to downward airflow. The terminal unit controller can be programmed to provide default limits such as those shown, from 0.75 to 1.25 times the setpoint value. This is the presently preferred arrangement. Moreover, the user can override or vary those limits, theoretically, from 0 to 100%. The same scheme applies to setting lighting level setpoints.

Control of airflow direction mix is illustrated by curve 204 in FIG. 4. It should be noted, however, that the airflow direction control aspect of the invention is useful independently of the light level adjustment aspect (and independently of radiant heating service as well). Any of the supplementary services can be used to advantage alone, or in combination with others. All three services illustrated are employed together in the presently preferred embodiment, although it is contemplated that terminal units may be employed that provide fewer than all three supplementary services in appropriate applications.

Importantly, each of the airflow direction mix and light level control operations can be implemented relative to different (heating and cooling) threshold temperatures. For simplicity of description, both modes are illustrated in FIG. 4 relative to a single cooling threshold temperature 208 and relative to a single heating threshold temperature 240, but different thresholds could be used. For example, the airflow direction mix adjustment could start at cooling setpoint plus one degree, while the light level might not be adjusted until the zone temperature reached cooling setpoint plus 1.6 degrees. Other variations in curve shape, hysteresis, and threshold values are within the scope of the present invention.

Curve 204 illustrates adjustment of airflow direction mix. Initially, the airflow direction mix is a normal setpoint, e.g. 70% indirect airflow, indicated by level 250 in the figure. This means that the regulating vanes in FIG. 3A are positioned such that 30% of the total air flow is directed through the downward outlet ports and 70% is directed through the horizontal outlet ports. This airflow direction mix is maintained as long as the zone temperature remains near the space temperature setpoint.

As indicated in the graph of FIG. 4, if the space temperature increases to the knee 252 of the airflow direction curve 204, which is at a cooling threshold temperature (equal to cooling setpoint+1 degree in this example), then the terminal unit begins to reduce the indirect airflow percentage, which is to say adjust the airflow direction mix toward a more direct airflow. In other words, when the zone temperature is too high, the unit succors the occupant by directing the cooled air (from the primary supply) more directly toward the user. This results in cooling the user more effectively, as well as making the user feel more comfortable due to perceiving the air motion. The airflow direction mix is further adjusted as temperature further increases, as indicated along ramp 254 of curve 204. This adjustment need not necessarily be linear as illustrated, but such an approach is useful and simplifies calculations in the unit controller.

At a predetermined minimum percentage indirect airflow, indicated by reference 256, e.g. 0.75 times the nominal indirect airflow setpoint, the airflow direction mix is held constant without regard to further increases in zone temperature. As illustrated, the maximum downward or direct airflow is employed at cooling setpoint +2. In the region between cooling setpoint and cooling threshold temperature, the airflow direction is not changed, but the unit modulates the cooling airflow volume as is known.

At zones temperatures below the workspace temperature setpoint 206, the airflow direction mix is maintained at the indirect airflow setpoint 250, down to a heating threshold temperature, e.g. heating setpoint minus one degree, indicated by dashed line 240. At this point, further decrease in zone temperature results in increasing the percentage indirect airflow, as indicated by ramp 260. In other words, since the workspace is cold, the controller directs more of the airflow along the ceiling, thereby avoiding the perception of a "draft" while warming the workspace. At a predetermined maximum percentage indirect airflow, indicated by reference level 262, e.g. 1.25 times the indirect airflow setpoint, the airflow direction mix is held constant without regard to further decreases in zone temperature.

In the presently preferred embodiment, at space temperatures above the cooling threshold temperature 208, the light level and percent of indirect airflow setpoints are simultaneously reduced by approximately 2.5% for each 0.1 degree F. the temperature is above the cooling threshold point. Therefore, at approximately 1.0 degree F. above the threshold, these setpoints have been reduced approximately 25% from their initial settings. This quantifies the "slope" of ramps 212, 254. These adjustments assist in providing a sense of comfort while the space temperature setpoint cannot be maintained. (These figures are for an independent unit). Similar adjustments are made on the heating side, as illustrated by ramps 242 (lighting level) and 260 (indirect airflow) of the graph of FIG. 4.

When the workspace is unoccupied, the unit controller will immediately drive the airflow direction mix to 100% direct downward airflow (i.e. 0% indirect airflow), to optimize air circulation and mixing in the workspace. Supplemental cooling continues as described so long as the area remains occupied and the space temperature remains above the cooling threshold temperature. Any manual operator adjustment of one or more of these supplemental services, however, overrides the described automatic adjustment of that service until the space temperature cooling setpoint is re-established, at which time the automatic adjustment capabilities for that service are returned to normal.

Radiant Heat Service

Curve 200 in FIG. 4 illustrates operation of a radiant heat service. Essentially, the radiant heat source (150 in FIG. 3) is turned on when the zone temperature falls below a predetermined increment, e.g. one-half degree, below the heating setpoint 218. Conversely, the radiant heat source is turned off when the temperature exceeds a predetermined increment, again e.g. one-half degree, above the heating setpoint. The resulting hysteresis provides stability and reduces wear from thermal cycling of the radiant unit. The radiant heating element is used whenever the space temperature falls below heating setpoint as a supplement for whatever primary air heating strategy(ies) exist. Supplemental radiant heating is continued until the heating setpoint is reached or the space becomes unoccupied. So long as the space temperature is above a predetermined heating threshold 240 (preferably approximately 1.0° F. below the space temperature heating setpoint), only the heating (or hot deck volume control for dual duct systems) of primary air is modulated in accordance with established variable air volume (and/or dual duct) control schemes. The present invention is intended for use with radiant panels that are "staged" or can be infinitely adjustable (e.g., by adjusting the voltage or current supplied to the unit). In this case, the radiant heat curve in FIG. 4 would look like the light or airflow curves.

Operation of Group Member Terminal Units

As noted above, an individual terminal unit can be configured at setup as a member of a designated group of such units. Operation of group member units is identical to that of independent units in the same area as described above with reference to FIG. 4. Group member units, however, detect occupancy and temperature in common. Occupancy sensing by any group member serving the same area sets all the group member units to an occupied state. A group also can be set up for coordinated temperature sensing. For example, assuming that several units have temperature sensors (onboard or coupled to the unit), the detected workspace temperatures can be averaged so as to form a group average workspace temperature. The setup program can be employed to designate which of the group member units will have their space temperature sensors active. The communications link can be used as a means for communicating to all of the group member terminal units an indication of the group average workspace temperature; and that figure can be used in the individual units as the zone temperature to control operation. Each unit can be programmed to compare the group average workspace temperature to its local zone temperature setpoint in connection with providing environmental services. However, a unit also could be programmed to participate as a group member by providing a temperature sensor, yet continue to operate independently otherwise. A manual adjustment received by any of the group member units makes that adjustment to all of the group member units. "Adjustment" here means manual adjustment of a setpoint (temperature, air flow direction, lighting level, etc.) by a user.

Also, where all units in an area (or floor or entire building) are interconnected by a common communications link, their unique addresses can be used for message passing, e.g. using computer network communications protocols which are known. During setup of a unit, when group member operation is selected, the user interface can request identification of the other members of the same group by address as well. While such an addressing scheme has several advantages of flexibility, ready expandability and lends itself to centralized control, an alternative embodiment is envisioned in which the selected neighboring units are "hard wired" for communication with one another. This approach may reduce hardware cost and improve reliability in some applications.

Operation of Open Area ("Neighborhood") Units

Figure 5:
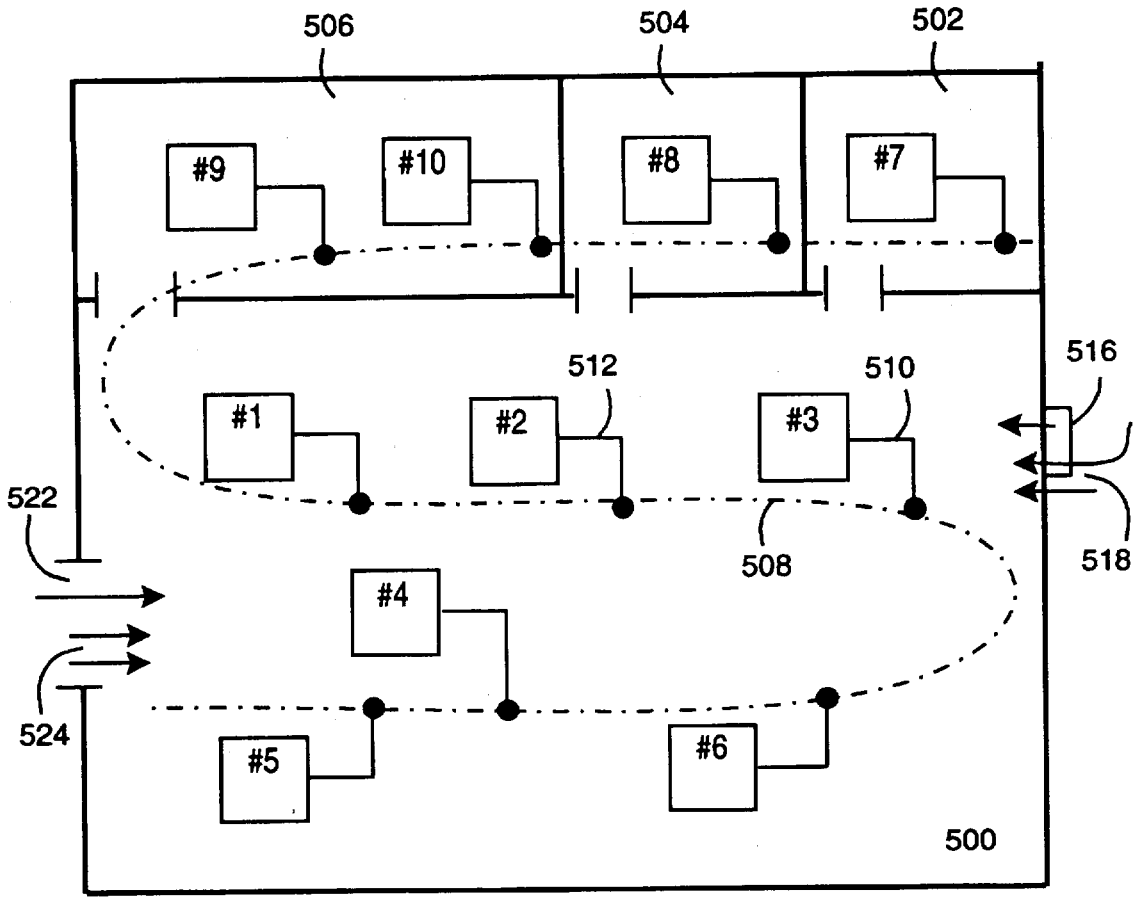
FIG. 5 is a top plan illustration of a plurality of individual terminal units disposed within a building and networked together for coordinated operation according to the present invention.

The foregoing description, with reference to FIG. 4, pertains to an enclosed office space—which may be served by a single independent terminal unit, or by a set of "group member" units as described. To illustrate, FIG. 5 shows terminal units #7 and #8 each operate in independent configuration, as they each serve an individual enclosed office 502, 504 respectively. In the case of an open office environment (or any open space, e.g. a manufacturing area) in which multiple terminal units are used, another aspect of the invention is to coordinate operation of each individual unit in response to conditions of other units within the same open area. The new environmental control system of the present invention thus coordinates the efforts of a plurality of individual units, while still taking into account the requirements of each individual workspace user.

Selection of Neighborhood Terminal Units

It is neither necessary nor desireable to coordinate operation of all individual terminal units throughout an open work area in all cases. For example, in a large manufacturing area served by, say 20 or 30 individual terminal units, some of the units will be located physically so far apart from other units that their respective operations do not measurably affect each other. On the other hand, the operations of a selected set of nearby or "neighborhood" units do affect each other, and are taken into account as will be described. The first step then, as each terminal unit is installed in a common open area, is to identify a set of neighborhood units to be taken into account in operation of the unit being installed. For this description, the unit being configured will be called the JOB unit, to distinguish it from its neighbors. This setup can be done using the setup program mentioned above. In a presently preferred embodiment, the neighborhood units are selected as those units located adjacent the job unit in each direction, within a predetermined limited distance. Each terminal unit in an area (or a whole building) can be assigned a unique identifier or "address". The respective addresses of selected neighborhood units are stored in memory in the job unit. Referring to FIG. 5, terminal units #1, #2, #3, #4, #5 and #6 all serve a common open area 500. Taking unit #2, for example, as the job unit, the selected neighborhood units will be identified at setup of unit #2. These are likely to be unit #1, unit #3 and unit #4. Units #5 and #6 are beyond a predetermined distance away from unit #2 such that they won't have much influence on the workspace #2 environment.

It is impractical to isolate the primary heating and cooling services in an open common area. Even where say, cooling air is being introduced through only a single individual unit, it will nonetheless diffuse around the common open area. Therefore the job unit communicates with each of the selected neighborhood units to determine each neighbor's respective local temperature and its local setpoints.

Cooling Operation in an Open Area ("Neighborhood") Unit

Referring again to FIG. 4, the airflow direction mix curve 204 has a knee 252 at cooling threshold temperature as noted above. Varying the cooling threshold temperature, for example reducing the threshold temperature, shifts the curve 204 by moving the knee 252 back to an alternate operating point 300. Accordingly, the ramp 254 is shifted to an alternate locus indicated by dashed line 310. The airflow direction knee can be varied from point 252 which is the nominal value—e.g. cooling setpoint+1 degree—down to a minimum temperature equal to the cooling setpoint, as illustrated by point 300. The position of the knee and ramp of curve 204, i.e. the zone temperatures at which adjustment of the airflow direction mix begins, is determined in dependence upon conditions in the selected neighborhood units surrounding the job unit as explained below.

The job unit controller examines the local zone temperatures and setpoints of each of the neighborhood units. If the job unit is above cooling setpoint, and all neighborhood units' respective local temperatures are above their respective cooling setpoints, then the job unit reacts in the cooling mode in the same manner as an independently configured terminal unit as described above. This may include providing supplemental services if the job unit space temperature is above its cooling threshold temperature.

Figure 6:
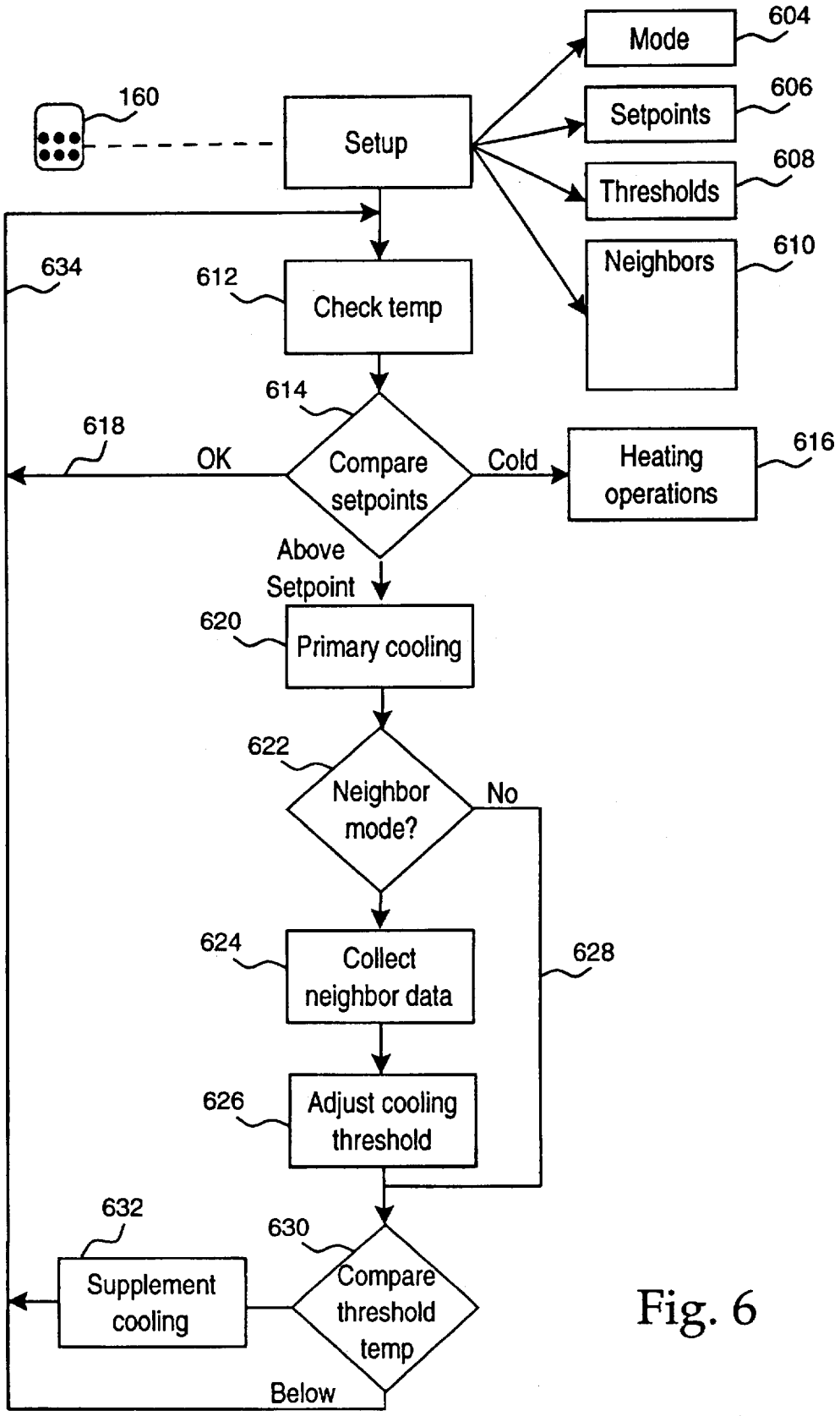
FIG. 6 is a flowchart illustrating a method of operation of the terminal unit of FIG. 3.

FIG. 6 is a flowchart summarizing a method of operation of the terminal unit of FIG. 3. This flowchart illustrates principally a cooling mode of operation; the heating mode of operation will be apparent by analogy in view of this description. In FIG. 6, the remote control 160 is used for interaction with a setup program 602, the setup program being executed by the microprocessor in the terminal unit. The setup program establishes the operating mode 604 as being either (a) independent, (b) group member or (c) common area. The setup program also establishes setpoints 606 for this particular unit. This may be a single temperature setpoint, or heating and cooling setpoints designated separately. The setup program 602 also establishes thresholds 608 for this unit. This refers to the heating threshold and cooling threshold temperatures (240 and 208, respectively in the graph of FIG. 4). These threshold temperatures determine the temperatures at which supplemental heating or cooling surfaces are provided as noted above. The threshold temperatures may be determined automatically by the controller relative to the usual space temperature setpoint. Finally, the setup program 602 is used to identify neighborhood terminal units 610 by storing their respective addresses in memory.

After setup is complete, normal operation begins with checking temperature 612. This refers to the local zone temperature as sensed by the subject unit. The zone temperature is compared to the established setpoints 606 in step 614. If the unit is cold (below heating setpoint), normal heating operations 616 are commenced. If the unit is within setpoint, control proceeds via loop formed by path 618, 634 to recheck the temperature periodically. If step 614 determines that the zone temperature is above the cooling setpoint, primary cooling service 620 is initiated as in prior art. Decision 622 checks whether the operating mode 604 is set to the neighborhood mode. If so, the controller proceeds to collect data from the neighboring units, steps 624, as described in FIG. 7 later. After neighborhood data is collected, the cooling threshold temperature is adjusted 626, as described later in greater detail with reference to FIG. 8.

Next step 630 compares the zone temperature to the cooling threshold temperature. If the zone temperature is above the cooling threshold, supplemental cooling services are applied 632 as described above. Otherwise, the process proceeds along path 634 to recheck the temperature 612. Referring again to decision 622, if the subject unit is not in the neighborhood operating mode, control proceeds via path 628 to skip the processes of collecting neighborhood data and adjusting the cooling threshold in response to that data.

Figure 7:
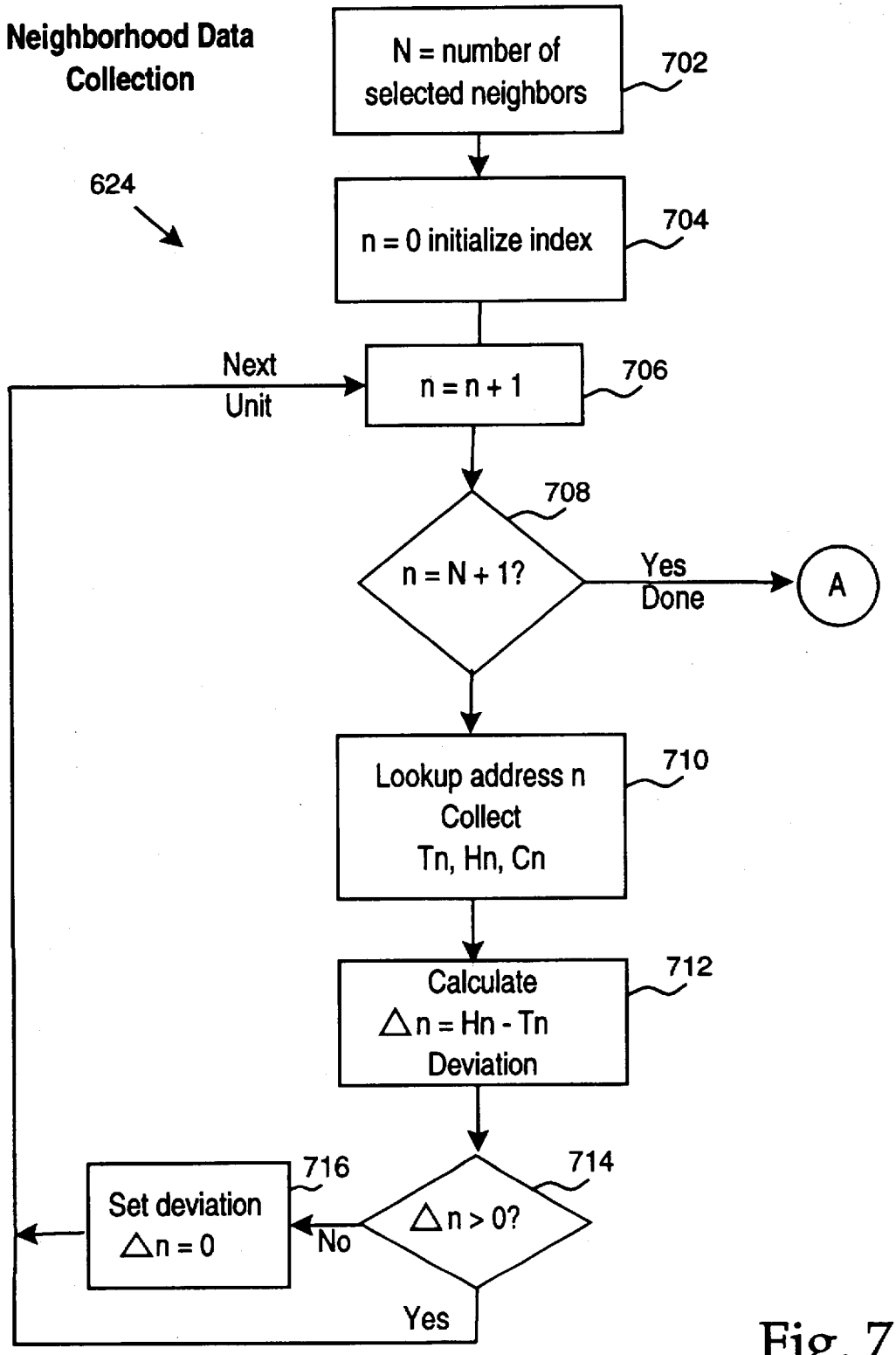
FIG. 7 is a flowchart illustrating a method of collecting data from neighboring terminal units.

The neighborhood zones are taken into account as follows. Referring to FIG. 7, a process for collecting data from the selected neighborhood units is illustrated as a flowchart. "N" is equal to the number of selected neighborhood units, step 702. Step 704 is to initialize an "index n" as a technique for addressing a neighborhood unit one at a time. Other techniques for accomplishing the same function will be apparent to those skilled in the art. The index "n" is initialized to zero.

In step 706, the index is incremented by 1, so that it "points to" a first one of the selected neighbors. Step 708 tests whether data has been collected from all of the selected neighborhood units. If so, the process moves to step "A", discussed later. If the process has not been completed, the next step 710 is to look up the address of unit "n" and then collect data from that unit. The information collected from each neighborhood unit includes: $T_n$ the temperature detected in workspace "n"; $H_n$ the heating setpoint temperature for unit "n"; $C_n$ the cooling setpoint for unit "n" ; and $O_n$ an indication of occupancy in workspace "n".

The next step is to calculate a deviation $\Delta_n$ which indicates the amount that the zone temperature is below the heating setpoint. Next, in decision 714, determine whether that deviation is greater than zero. If not (implying the zone temperature is at least equal to the heating setpoint), then the deviation is set to zero in step 716. Accordingly, all zones in which the local zone temperature is at least as high as the local zone heating setpoint are considered to have a zero value deviation.

If the deviation is greater than zero, control proceeds along path 718 back to step 706 to increment the index "n" for addressing the next neighborhood unit. Again we test for completion in step 708 and, if data has not yet been collected from all the selected neighborhood units, the foregoing process is repeated for collecting data in step 710, calculating the deviation in step 712, forcing the deviation to zero where the local temperature is not below heating setpoint, and repeating. The exact information transmitted over the communications link, with respect to what information might be determined locally in each unit, will be a matter of design choice in a particular system. For example, the indication of occupancy $O_n$ could be transmitted from each unit to the inquiring job unit. Where a particular zone is not occupied, the job unit could use that information to exclude that unit from the data collection process of FIG. 7. Alternatively, each unit, if it is unoccupied, might automatically "spread" its own heating and cooling setpoints thereby allowing a broader variation in temperature in that zone thereby saving energy in areas not currently occupied. Information from that zone could still be collected as indicated in step 710 and taken into account, but in all likelihood the resulting deviation will be zero. In another variation, instead of transmitting local zone temperatures and heating setpoints, the deviation $\Delta_n$ could be determined in each individual unit and transmitted to the inquiring job unit.

Figure 8:
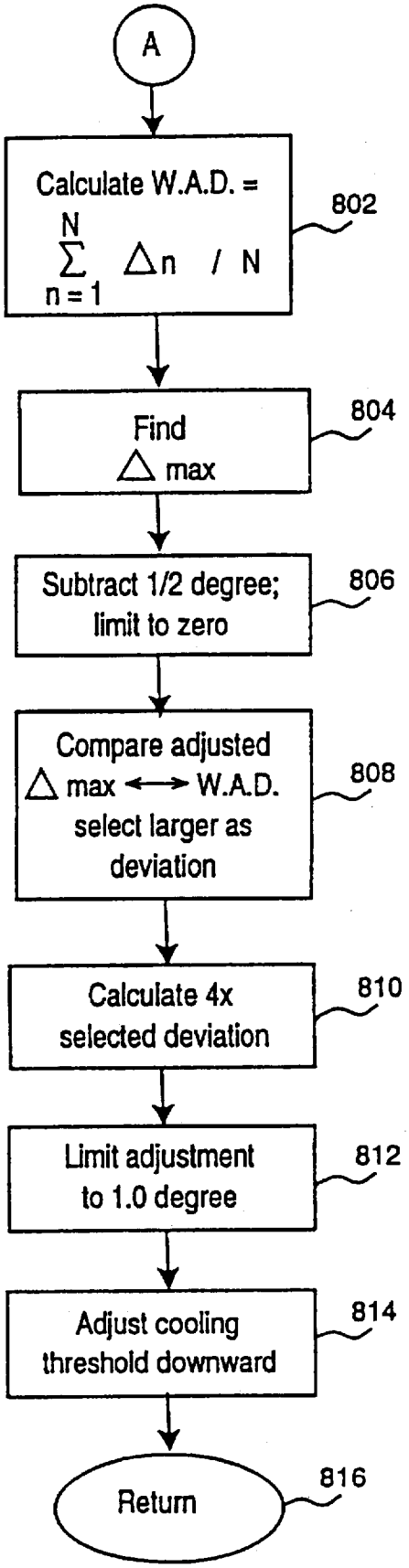
FIG. 8 is a flowchart illustrating a method of adjusting threshold temperature in response to data collected from neighboring terminal units.

Once the necessary information has been collected from all of the selected neighborhood units, the process proceeds as indicated at label "A" to the flowchart of FIG. 8. The process of FIG. 8 is to determine an amount of adjustment of the cooling threshold temperature in response to the conditions of neighboring units. First, step 802 is to calculate a "weighted average deviation" ("W.A.D.") which is equal to the sum of the deviations determined according to the process of FIG. 7, divided by N (the number of selected neighbors). For example, if there were a total of 3 neighboring units, and one of them was within setpoint (i.e., had a deviation equal to zero), and the other two units had deviations of 0.2° and 0.3°, then the weighted average deviation would be equal to 0.5÷3 which equals 0.0167°.

Next, the largest single deviation $\Delta_{max}$ is identified in step 804. $\Delta_{max}$ corresponds to the "coldest" unit, not in an absolute temperature sense, but referring to the unit where the local zone temperature deviates the furthest from the local heating setpoint. That deviation is identified, and then in step 806, ½° is subtracted therefrom, so as to determine the amount by which the "coldest" unit temperature is more than ½° below the heating setpoint. This figure cannot be less than zero. So, for example, if the coldest unit deviation is 0.3°, it would be considered to be zero rather than a negative number. This "adjusted maximum deviation" is compared to the weighted average deviation calculated in step 802, and the larger figure is selected in step 808. Continuing the prior example, the largest deviation was 0.3. This is less than ½° so the adjusted maximum deviation would be zero. Accordingly, the larger of the two would be the weighted average deviation, determined earlier as 0.167. The selected larger deviation is multiplied by 4 in step 810, with the result of 0.668° in the example. This figure is then clamped or limited to a maximum of 1° in step 812, which does not change the result in this example. Finally, the cooling threshold temperature is adjusted downward in step 814 by the adjustment amount determined in the foregoing process. Referring then to FIG. 4, the cooling threshold temperature indicated by dashed line 208 would be adjusted in the job unit under discussion, downward from the knee 210 (referring to the light level operating curve 202) by the adjustment amount 0.668° to an adjusted knee location 311. This adjusts the ramp 212 laterally as indicated by arrow 315 so that it assumes an adjusted ramp location 312. An analogous process may be applied to adjust the cooling threshold for purposes of controlling airflow direction as indicated by dashed line 310. As noted earlier, the same cooling threshold temperature need not necessarily be used for both lighting level and airflow direction control.

These automatic control processes are further illustrated by way of example with reference to FIG. 5. FIG. 5 is a top plan view of a floor of a building that includes a common open area 500, individual offices 502, 504 and a large office 506. Terminal units #7 and #8 are configured for individual operation to serve the individual offices 502, 504, respectively. Terminal units #9 and #10 are configured to work together as a group of terminal units with identical setpoints and operating characteristics to serve the larger enclosed space 506. Operation of individual and group terminal units is described above. Finally, each of the remaining terminal units #1–#6 serves a respective individual workstation in an open area and is configured to operate as a neighborhood unit. Terminal unit #2, for example, is configured to select unit #1, #3 and #4 as its selected neighborhood units. Units #5 and #6 essentially will be ignored in the operation of unit #2 because they are located more than a predetermined maximum distance from unit #2, that distance being selected such that operation of units more than that distance apart will have little or no effect on the respective zones of the other unit. All of the terminal units in the diagram of FIG. 5 are interconnected by a common communications link 508. In this illustration, each unit is tethered to the communications link, for example by network connection 510, 512 connecting units #3 and #2 to the communications link 508.

When unit #2 is set up, it is configured to operate in common area ("neighborhood") mode, and the addresses of neighborhood units #1, #3 and #4 are stored in memory in unit #2. Its operation, with respect to the neighboring units, is described above, with reference to the flowcharts of FIGS. 7 and 8.

Heating Mode Operation for an Open Area Unit

In general, the radiant heating element is turned on whenever the space temperature falls below heating setpoint as a supplement for whatever primary air heating strategy (ies) exist. Supplemental radiant heating is continued until the heating setpoint is reached or the space becomes unoccupied. If all neighborhood units (selected during setup as noted) are also below their respective heating setpoints, then the job unit reacts in the heating mode with the same operating characteristics as an independently installed unit as described above. The status of neighborhood units may be determined by each unit broadcasting its local temperature, setpoints, etc. over the communications link. Alternatively, each unit could broadcast only a status report, indicating one of three states, namely: within setpoint, heating or cooling.

However, if any of the neighborhood units are above setpoint, i.e. cooling is required of at least one of them while heating is required of the job unit, then the weighted average deviation is limited to those units that are above (cooling) setpoint. This weighted average deviation is of course in the opposite direction from the deviation of the job terminal unit. Thus, it may be said that the "weighted average deviation" provides an indication of the extent to which neighborhood zones require just the opposite service (cooling vs. heating) of that required in the job unit zone.

If a weighted average deviation of the selected neighborhood units is above cooling setpoint or any one adjacent box is more than 0.5 degree F. above its cooling setpoint, then the heating threshold temperature 240 (the temperature for supplemental comfort conditioning services to be employed), is increased from the nominal 1 degree F. below heating setpoint, again at a presently preferred rate of approximately four times the weighted average deviation of neighborhood boxes above their cooling setpoints, or the amount the maximum box is more than 0.5 degree F. above its cooling setpoint, which ever is higher. Consequently, when the average of adjacent boxes is 0.25 degree F. above setpoint, or the maximum (hottest) box is 0.5 degree F. above setpoint, the heating threshold temperature for supplemental services is equal to the heating setpoint and therefore supplemental comfort services are initiated as soon as the space temperature falls below the heating setpoint.

Referring again to FIG. 4, the lighting level service is illustrated by curve 202. It's default operation (or when configured as an individual office unit) includes adjusting the lighting level along ramp 242 as noted. When neighborhood units are cooling, as just described, the "knee" is moved to 245, and light level is adjusted along ramp of dashed line 247, up to the predetermined maximum level 244. Thereafter, higher neighborhood space temperatures no longer make any further adjustment of the job unit heating threshold temperature. With the threshold temperature adjusted as described, the supplementary comfort services are applied based on the relation of the space temperature to the threshold temperature as described earlier. The airflow direction mix is arranged to operate in a manner analogous to the lighting service in an open area terminal unit, as described above.

Referring to the Table below, it shows data acquired by unit #2 from the designated neighborhood units #1, #3, and #4, to illustrate calculations of the threshold temperature adjustment. The results shown in tabular form in the Table are arrived at by the process shown and described with reference to FIGS. 7 and 8. The first set of data ("A") indicates a lower zone temperature as measured at unit #3. This may result, for example, from cold outside air 518 flowing through an open window 516 as shown in FIG. 5. The result in this case is the maximum threshold temperature adjustment of 1 degree. The data labeled "B" illustrates another example, in which unit #3 again is at a temperature substantially below its heating setpoint. As a result, once again, the maximum threshold adjustment of 1 degree is effected in the unit #2 cooling threshold temperature.

Data set "C" in the Table shows the neighborhood units only slightly below their respective heating setpoints $H_n$. The result is to adjust the unit #2 cooling threshold temperature downward by 0.04 degrees. Data sets "D" and "E" provide additional examples of the computations described above.

| | UNIT #2 | | | | | | |
|---|---|---|---|---|---|---|---|
| | Unit # | Hn | Tn | Deviation | Avr | Adjusted Max | Threshold Adjustment |
| A | 1 | 67.0 | 66.9 | 0.1 | | | |
| | 3 | 67.1 | 66.8 | 0.3 | | | |
| | 4 | 67.2 | 66.7 | 0.5 | | | |
| | | | | | 0.3 | 0 | 1.0 |
| B | 1 | 67.0 | 66.9 | 0.1 | | | |
| | 3 | 67.1 | 66.5 | 0.6 | | | |
| | 4 | 67.2 | 66.7 | 0.5 | | | |
| | | | | | 0.4 | 0.1 | 1.0 |
| C | 1 | 67.0 | 66.9 | 0.1 | | | |
| | 3 | 67.1 | 66.9 | 0.2 | | | |
| | 4 | 67.2 | 67.1 | 0.1 | | | |
| | | | | | 0.1 | 0 | 0.4 |
| D | 1 | 67.0 | 66.8 | 0.2 | | | |
| | 3 | 67.1 | 67.1 | 0.0 | | | |
| | 4 | 67.2 | 66.5 | 0.7 | | | |
| | | | | | 0.3 | 0.2 | 1.0 |
| E | 1 | 67.0 | 67.0 | 0.0 | | | |
| | 3 | 67.1 | 67.1 | 0.0 | | | |
| | 4 | 67.2 | 66.48 | 0.72 | | | |
| | | | | | 0.24 | 0.22 | 0.96 |

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of improving comfort for a user occupying a substantially closed individual workspace within a building, the building further including a primary supply of conditioned air available to the workspace, and the method comprising the steps of:

determining a cooling setpoint temperature for the workspace;

selecting a cooling threshold temperature for the workspace greater than the cooling setpoint temperature for the workspace;

monitoring the workspace so as to detect occupancy of the workspace;

monitoring a temperature of the workspace;

if occupancy of the workspace is detected and the workspace temperature exceeds the setpoint temperature, providing conditioned air from the primary supply into the workspace to cool the workspace; and while occupancy of the workspace is detected and the workspace temperature exceeds the cooling threshold temperature, additionally and automatically providing supplemental comfort services so as to improve comfort for the user without directly affecting load on the building primary supply.

2. A method according to claim 1 wherein the building includes means for adjusting a lighting level within the individual workspace and said step of providing supplemental comfort services includes automatically lowering the lighting level within the individual workspace as long as the individual workspace temperature exceeds the cooling threshold temperature.

3. A method according to claim 2 wherein the step of lowering the lighting level comprises lowering the lighting level in dependence upon the workspace temperature according to a predetermined operating curve.

4. A method according to claim 2 further comprising limiting said step of lowering the lighting level so as to maintain at least a predetermined minimum lighting level in the individual workspace as long as occupancy of the workspace is detected.

5. A method according to claim 2 further comprising:

receiving a manual adjustment of the workspace lighting level;

in response to the manual adjustment of the workspace lighting level, discontinuing said automatic adjustment of the lighting level until the workspace temperature reaches the cooling setpoint; and in response to the workspace temperature reaching the cooling setpoint, resuming said automatic adjustment of the lighting level whereby the user can manually control operation of the supplemental comfort services.

6. A method according to claim 2 wherein said cooling threshold temperature is selected as approximately one degree F. above the workspace cooling setpoint temperature.

7. A method of controlling the environment in a substantially closed individual workspace within a building, the building including a primary supply of conditioned air available to the workspace, and the method comprising the steps of:

determining a cooling setpoint temperature for the workspace;

defining a cooling threshold temperature for the workspace greater than the cooling setpoint temperature for the workspace;

monitoring the workspace so as to detect occupancy of the workspace;

monitoring a temperature in the workspace;

while occupancy of the workspace is detected and the workspace temperature exceeds the cooling threshold temperature, automatically adjusting a direction mix of the conditioned airflow into the workspace toward a downward airflow direction so as to provide airflow cooling to an occupant of the workspace.

8. A method according to claim 7 further comprising:

determining a temperature increment defined as an amount by which the workspace temperature exceeds the threshold temperature; and wherein said adjusting the airflow direction mix includes adjusting the airflow direction mix as a function of the determined temperature increment.

9. A method according to claim 7 and further comprising the steps of:

if the airflow direction mix is adjusted manually by a user, discontinuing said automatic adjustment of the airflow direction mix until the individual workspace temperature reaches the cooling setpoint; and when the workspace temperature reaches the cooling setpoint, resuming said automatically adjusting the airflow direction mix responsive to the workspace temperature.

10. A method according to claim 7 further comprising limiting said adjusting the airflow direction mix so as to maintain the airflow direction mix within predetermined limits notwithstanding changes in the workspace temperature.

11. A method according to claim 7 further comprising, if occupancy of the workspace is detected and the workspace temperature exceeds the cooling threshold temperature, reducing a lighting level in the workspace.

12. A method according to claim 7 further comprising, while occupancy of the workspace is not detected and the workspace temperature exceeds the cooling threshold temperature, automatically adjusting the conditioned airflow direction mix to a substantially downward airflow direction, thereby improving effectiveness of primary air delivery into the workspace while occupancy is not detected.

13. A method of controlling the environment in a substantially closed workspace within a building, the building including a primary supply of conditioned air available to the workspace, and the method comprising the steps of:

determining a heating setpoint temperature for the workspace;

defining a heating threshold temperature lower than the heating setpoint temperature for the workspace;

monitoring the workspace so as to detect occupancy of the workspace;

monitoring a temperature of the workspace; and while occupancy of the workspace is detected and the workspace temperature is below the heating threshold temperature, automatically providing at least one supplemental comfort service so as to improve user comfort without substantially affecting load on the building primary supply system.

14. A method according to claim 13 wherein the building includes means for adjusting a lighting level within the workspace and said step of providing supplemental comfort services includes automatically raising the workspace lighting level as long as the workspace temperature is below the heating threshold temperature.

15. A method according to claim 14 wherein the step of raising the lighting level comprises raising the lighting level as a function of an amount by which the workspace temperature is below the heating threshold temperature.

16. A method according to claim 14 further comprising limiting said raising the lighting level so as to maintain the lighting level within a predetermined maximum lighting level notwithstanding changes in the workspace temperature.

17. A method according to claim 14:

further comprising, in response to a manual adjustment of the workspace lighting level, discontinuing said automatic adjustment of the lighting level until the workspace temperature reaches the heating setpoint; and then, in response to the workspace temperature reaching the heating setpoint, resuming said automatic adjustment of the lighting level whereby the user can manually override operation of the lighting level adjustment.

18. A method according to claim 14 wherein said heating threshold temperature is selected as approximately one degree F. below the workspace heating setpoint temperature.

19. A method of improving comfort for a user occupying a substantially closed workspace within a building comprising the steps of:

determining a heating setpoint temperature for the workspace;

defining a heating threshold temperature for the workspace lower than the heating setpoint temperature for the workspace;

monitoring the workspace so as to detect occupancy of the workspace;

monitoring a temperature of the workspace;

while occupancy of the workspace is detected and the workspace temperature is below the heating setpoint temperature, directing heated airflow into the workspace to warm the workspace; and while occupancy of the workspace is detected and the workspace temperature is below the heating threshold temperature, automatically adjusting an airflow direction mix of the heated airflow into the workspace so as to increase a percentage of indirect airflow, thereby directing the flow of heated air along a generally horizontal direction so as to minimize drafts in the workspace.

20. A method according to claim 19 further comprising, while occupancy of the workspace is not detected and the workspace temperature is below the heating threshold temperature, automatically adjusting the conditioned airflow direction mix to a substantially downward airflow direction, thereby improving effectiveness of primary air delivery into the workspace while occupancy is not detected.

21. A method according to claim 19 further comprising limiting said adjusting the airflow direction mix so as to maintain the airflow direction mix within predetermined directional limits notwithstanding changes in the workspace temperature.

22. A method according to claim 19 further comprising, in response to a manual adjustment of the heated airflow direction mix, discontinuing said automatic adjustment of the airflow direction mix until the workspace temperature reaches the heating setpoint; and then, in response to the workspace temperature reaching the heating setpoint, resuming said automatic adjustment of the airflow direction mix whereby the user can manually override the automatic airflow direction mix adjustment.

23. A method according to claim 19 further comprising, if occupancy of the workspace is detected and the workspace temperature is below the heating threshold temperature, automatically increasing a lighting level in the workspace.

24. A method according to claim 19 wherein the step of adjusting the airflow direction mix comprises adjusting the airflow direction mix as a predetermined function of the amount by which the workspace temperature is below the heating threshold temperature.

25. A method according to claim 24 wherein said adjusting the airflow direction mix comprises increasing a percentage of indirect airflow by approximately 2.5 percent for each 0.1 degree F. difference between the workspace temperature and the heating threshold temperature, so that the airflow direction mix will be approximately 25 percent more indirect than the indirect airflow setpoint mix when the workspace temperature is one degree below the heating threshold temperature.

26. A method of delivering primary air into a space comprising the steps of:

monitoring occupancy of the space;

providing a diffuser mounted in the ceiling of the space, the diffuser comprising an inlet duct for receiving a supply of primary air, a first outlet port for directing air from the inlet duct into the space along a generally horizontal direction, a second outlet port for directing air from the inlet duct into the space along a generally downward direction, and adjustable relating means for providing a first portion of the primary air from the inlet duct into the first outlet port and a second portion of the primary air from the inlet duct into the second outlet port, so as to provide an adjustable airflow direction mix of horizontal and downward primary airflow into the space;

providing a supply of primary air to the diffuser inlet duct;

when occupancy of the space is detected, setting the diffuser regulating means to a first predetermined setting so as to provide a first mix of horizontal and downward flow of the primary air into the space; and when occupancy of the space is not detected, setting the diffuser regulating means to a second predetermined setting so as to provide a second mix of horizontal and downward flow of the primary air into the space, the second mix having a greater proportion of downward airflow than the first mix, thereby improving effectiveness of primary air delivery into the space while occupancy is not detected.

27. A method according to claim 26 wherein the second diffuser setting directs substantially all of the primary air into the space in a substantially downward direction, thereby maximizing effectiveness of primary air delivery.

28. An individual terminal unit for connection to a primary supply of conditioned air in a variable air volume heating and cooling system to serve a zone of a building in which the individual terminal unit is installed, comprising:

inlet means for connection to the primary air supply to receive conditioned air flow;

a temperature sensor for providing an indication of a space temperature;

input means for receiving an indication of a zone temperature setpoint settable by a user;

an adjustable relating vane for controlling an airflow direction mix of conditioned airflow out of the terminal unit and into the zone;

an electronic controller coupled to the temperature sensor, the input means and to the regulating vane for controlling the regulating vane and thereby adjusting the airflow direction mix in dependence upon the indicated zone temperature and the zone temperature setpoint;

means in the electronic controller for configuring the terminal unit as a group member terminal unit for use in an enclosed zone in the building together with at least one other group member terminal unit; and communication means for coordinating operation of the terminal unit with said at least one other group member terminal unit; and a memory for storing addresses uniquely identifying said at least one other terminal unit as a member of the same group of terminal units.

29. A variable air volume environmental conditioning system comprising:

a primary supply of conditioned air;

a plurality of individual terminal units each coupled to the primary air supply, and each of said terminal units designated as a member of a selected group of terminal units;

means in at least one group member terminal unit for detecting occupancy in a corresponding workspace area adjacent the group member terminal unit;

means for communicating to all of the group member terminal units an indication that occupancy is detected in the corresponding workspace area adjacent said at least one group member terminal unit; and means in each group member terminal unit for operating in an occupied mode of operation in response to the said indication that occupancy is detected in said at least one of the workspace areas.

30. A variable air volume environmental conditioning system according to claim 29 and further comprising:

means for receiving a manual adjustment of supplemental services;

means for communicating an indication of the manual adjustment to the other group member terminal units; and means in each group member terminal unit for adjusting supplemental services setpoints in response to the said indication of the manual adjustment.

31. A variable air volume environmental conditioning system according to claim 29 and further comprising:

means in at least one group member terminal unit for sensing temperature in a workspace area adjacent the terminal unit; and means for communicating to all of the group member terminal units an indication of the workspace temperature in the corresponding workspace area adjacent said at least one group member terminal unit.

32. A variable air volume environmental conditioning system according to claim 29 and wherein a plurality of the group member terminal units include respective means for sensing temperature in their respective workspaces; and further comprising:

means for mathematically combining the respective workspace temperatures sensed by said plurality of the group member terminal units so as to form a group average workspace temperature;

means for communicating to all of the group member terminal units an indication of the said group average workspace temperature; and means in at least one of the group members for comparing the group average workspace temperature to a predetermined temperature setpoint in connection with providing environmental control services.

33. An individual terminal unit for connection to a primary supply of conditioned air in a variable air volume heating and cooling system to serve a zone of a building in which the individual terminal unit is installed, comprising:

inlet means for connection to the primary air supply to receive conditioned air flow;

a temperature sensor for providing an indication of a space temperature;

input means for receiving an indication of a zone temperature setpoint settable by a user;

an adjustable regulating vane for controlling an airflow direction mix of conditioned airflow out of the terminal unit and into the zone;

an electronic controller coupled to the temperature sensor, the input means and to the regulating vane for controlling the regulating vane and thereby adjusting the airflow direction mix in dependence upon the indicated zone temperature and the zone temperature setpoint;

means in the electronic controller for configuring the terminal unit as a neighborhood terminal unit for use in an open zone in the building together with at least one other neighborhood terminal unit;

communication means for coordinating operation of the terminal unit with said at least one other neighborhood terminal unit; and a memory for storing addresses uniquely identifying said at least one other terminal unit as a member of the neighborhood.

34. An individual terminal unit for connection to a primary supply of conditioned air in a variable air volume heating and cooling system to serve a zone of a building in which the individual terminal unit is installed, comprising:

inlet means for connection to the primary air supply to receive conditioned air flow;

a temperature sensor for providing an indication of a space temperature;

input means for receiving an indication of a zone temperature setpoint settable by a user;

an adjustable regulating vane for controlling an airflow direction mix of conditioned airflow out of the terminal unit and into the zone;

an electronic controller coupled to the temperature sensor, the input means and to the regulating vane for controlling the regulating vane and thereby adjusting the airflow direction mix in dependence upon the indicated zone temperature and the zone temperature setpoint;

wherein the electronic controller includes means for interfacing to a light source in the zone for adjusting light level in the zone in response to the zone temperature indicated by the temperature sensor and the indicated zone temperature setpoint.

35. A method according to claim 34 further comprising:

selecting a heating setpoint temperature for the job unit workspace;

in the job unit, selecting a heating threshold temperature lower than the heating setpoint temperature for controlling supplemental heating services in the job unit; and adjusting the heating threshold temperature for the job unit in response to the weighted average deviation of the other neighborhood terminal units;

limiting the heating threshold temperature to within a range bounded by the initial heating threshold temperature and the heating setpoint temperature.

36. A method of operation of a VAV system having a plurality of terminal units each installed within a common area, and each of the terminal units serving a corresponding workspace within the common area, the method comprising:

defining one of the terminal units as a job unit;

selecting a cooling setpoint temperature for the job unit workspace;

in the job unit, selecting an initial cooling threshold temperature greater than the cooling setpoint temperature for controlling supplemental cooling services in the job unit;

in the job unit, selecting a plurality of the other terminal units for operation as neighborhood terminal units;

in the job unit, collecting operating data from the other neighborhood terminal units;

determining a weighted average deviation responsive to the collected data;

adjusting the cooling threshold temperature for the job unit in response to the weighted average deviation of the other neighborhood terminal units; and limiting the cooling threshold temperature to within a range bounded by the initial cooling threshold temperature and the cooling setpoint temperature.

37. A method of controlling the environment in a substantially closed workspace within a building, the building including a primary supply of conditioned air available to the workspace, and the method comprising the steps of:

determining a heating setpoint temperature for the workspace;

defining a heating threshold temperature lower than the heating setpoint temperature for the workspace;

providing a radiant heat source within the workspace;

monitoring the workspace so as to detect occupancy of the workspace;

monitoring a temperature of the workspace; and while occupancy of the workspace is detected and the workspace temperature is below the heating threshold temperature, automatically activating the radiant heating source for radiating heat into the workspace thereby improving user comfort without directly affecting load on the building primary supply.

* * * * *